US005905474A

United States Patent [19]

Ngai et al.

[11] Patent Number: 5,905,474

[45] **Date of Patent: *May 18, 1999**

[54] FEED SPOILER FOR MICROWAVE ANTENNA

[75] Inventors: Eugene Ngai, Northboro, Mass.; Robert Whiting, Windham, Me.

[73] Assignee: Gabriel Electronics Incorporated, Scarsborough, Me.

[21] Appl. No.: 08/861,486

[22] Filed: May 22, 1997

Related U.S. Application Data

[ 60] Provisional application No. 60/020,884, Jun. 28, 1996.

[51] Int. Cl.[6] ..... H01Q 19/12

[52] U.S. Cl. ..... 343/840; 343/779; 343/786

[58] Field of Search ..... 343/840, 772, 343/779, 786, 765, 777; 333/248, 237

[56] References Cited

U.S. PATENT DOCUMENTS

| | | | |
|---|---|---|---|
| 3,196,442 | 7/1965 | Leffelman et al. | 343/765 |
| 3,412,405 | 11/1968 | Crotty et al. | 343/777 |
| 4,376,940 | 3/1983 | Miedema | 343/840 |
| 4,631,547 | 12/1986 | Jacavanco | 343/840 |

*Primary Examiner*—Don Wong
*Assistant Examiner*—Hoang Nguyen
*Attorney, Agent, or Firm*—Bromberg & Sunstein LLP

[57] ABSTRACT

A microwave antenna feed spoiler for reducing side lobes of a microwave antenna with a feed support. The microwave antenna feed spoiler provides one or more segments of electrically conducting surface forming a roof which is coupled to and hides beneath it at least a portion up to the whole length of the feed support.

21 Claims, 10 Drawing Sheets

FEED SPOILER FOR MICROWAVE ANTENNA

The present application claims priority from U.S. provisional application Ser. No. 60/020,884, filed Jun. 28, 1996, which is herein incorporated by reference.

TECHNICAL FIELD

The present invention pertains to a microwave antenna feed, and, in particular, to a feed spoiler for reducing side lobes due to a microwave antenna feed support.

BACKGROUND OF THE INVENTION

The use of waveguides for plane polarized feeds in microwave antennas causes degradation in the antenna radiation pattern due to the electromagnetic scattering effects of the outer surface of the waveguide on the radiation emitted from the aperture of the feed as well as the radiation reflected from the reflector surface. The results of poor radiation patterns include degraded antenna gain, cross-polarization, and undesirable directional coverage. These deleterious results apply in equal measure to antennas used for transmitting microwave radiation and to antennas used for receiving microwave radiation. These effects, in the past, have been mitigated by the use of microwave absorber on the waveguide bend surfaces. Problems associated with the use of absorber include an increase in the first few co-polarization side lobes due to the thickness of the absorber, long term weatherability issues, and the effects of moisture absorption by the microwave absorber.

SUMMARY OF THE INVENTION

In accordance with one aspect of the invention, in one of its embodiments, there is provided a feed spoiler for reducing sidelobes of a microwave antenna with a feed support. The microwave antenna is characterized by a concave reflector, a beam axis, and a feed horn supported by the feed support at an end opposite to the concave reflector. The feed spoiler has at least one segment of electrically conductive surface forming a roof, as defined below, with two faces. Each face has two edges. One edge of each face is separated from the same edge of the other face by at least the width of the feed support, while the remaining edges are joined to form at least one ridge in such a manner as to substantially cover at least one segment of the feed support. In accordance with alternate embodiments of the invention, a ridge may parallel a segment of the feed support, and edges of the faces of the roof structure may be electrically coupled to the feed support. Particular portions of the feed support which may be substantially covered by respective segments of the feed spoiler include a portion facing the feed horn, a portion perpendicular to the beam axis and facing the concave reflector, and a portion perpendicular to the beam axis and facing away from the concave reflector.

The microwave antenna feed spoiler described herein may both improve the cross-polarized radiation pattern of the antenna and narrow the horizontally polarized wide angle radiation pattern, particularly, of a shrouded antenna. Additionally, the asymmetric vertically polarized lobes may be reduced. The present invention provides the aforesaid improvements to the radiation pattern of the antenna while being durable, impervious to water, and easily fabricated from inexpensive materials. Other objects and advantages of the invention are in part apparent and in part pointed out hereinafter.

BRIEF DESCRIPTION OF THE DRAWINGS

The invention will be more readily understood by reference to the following description, taken with the accompanying drawings, in which.

DETAILED DESCRIPTION OF THE PREFERRED EMBODIMENT

Figure 1:
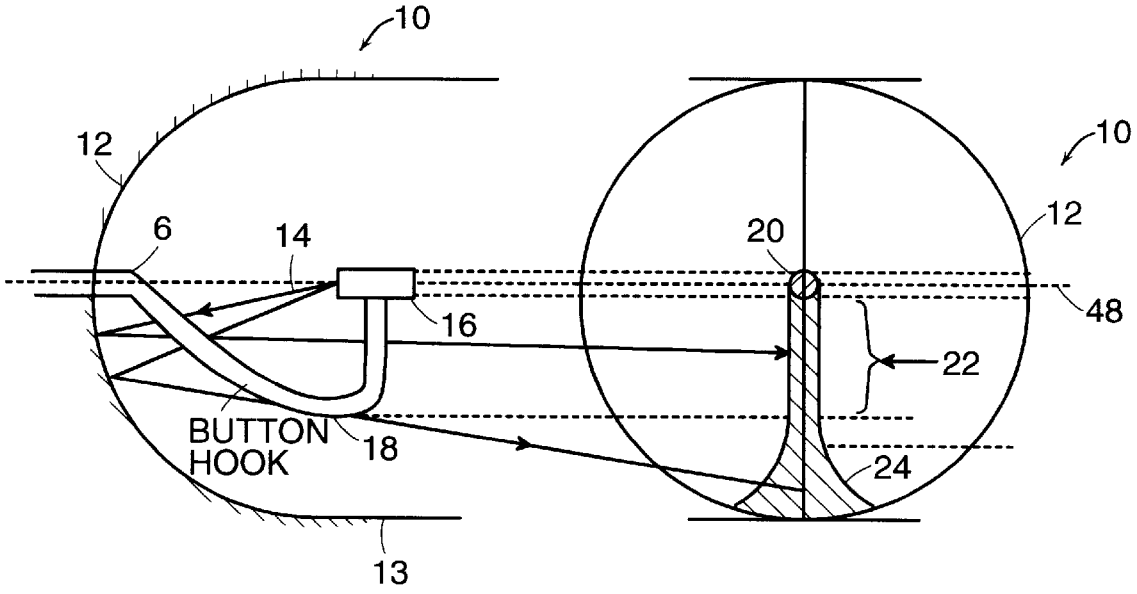
FIG. 1 PRIOR ART
FIG. 1 is a side view and front view of the prior art button hook feed support of a microwave antenna.

Referring now to FIG. 1, a side-view and front view are shown of a prior art microwave antenna, designated generally by numeral 10. When microwave antenna 10 is used for transmission, concave reflector 12 (typically parabolic) is illuminated with microwave radiation 14 by feed horn 16 and reflects microwave radiation 14 in a substantially collimated beam to a distant receiving antenna (not shown). A shroud 13 serves to reduce unwanted side lobes to some degree. Any microwave antenna discussed in this application may be equally applied for reception of microwave radiation. Microwave radiation 14 is typically coupled to feed horn 16 via waveguide 18 which serves also to support feed horn 16 mechanically. A typical configuration is the buttonhook configuration of waveguide 18 which is employed with rectangular waveguide to feed plane polarized microwave signals to feed horn 16. Feed horn 16 is disposed along central axis 48, with the waveguide bent away from central axis 48 at bend 6 in order to reduce obscuration of the primary lobe of feed horn 16. In the front view, seen from the direction of the outgoing microwave beam, or, equivalently, facing parabolic reflector 12, blockage and attendant scattering of the beam is depicted, specifically, feed blockage 20 due to feed horn 16, plane wave blockage 22, due to the vertical component of waveguide 18, and spherical wave blockage 24.

Figure 2:
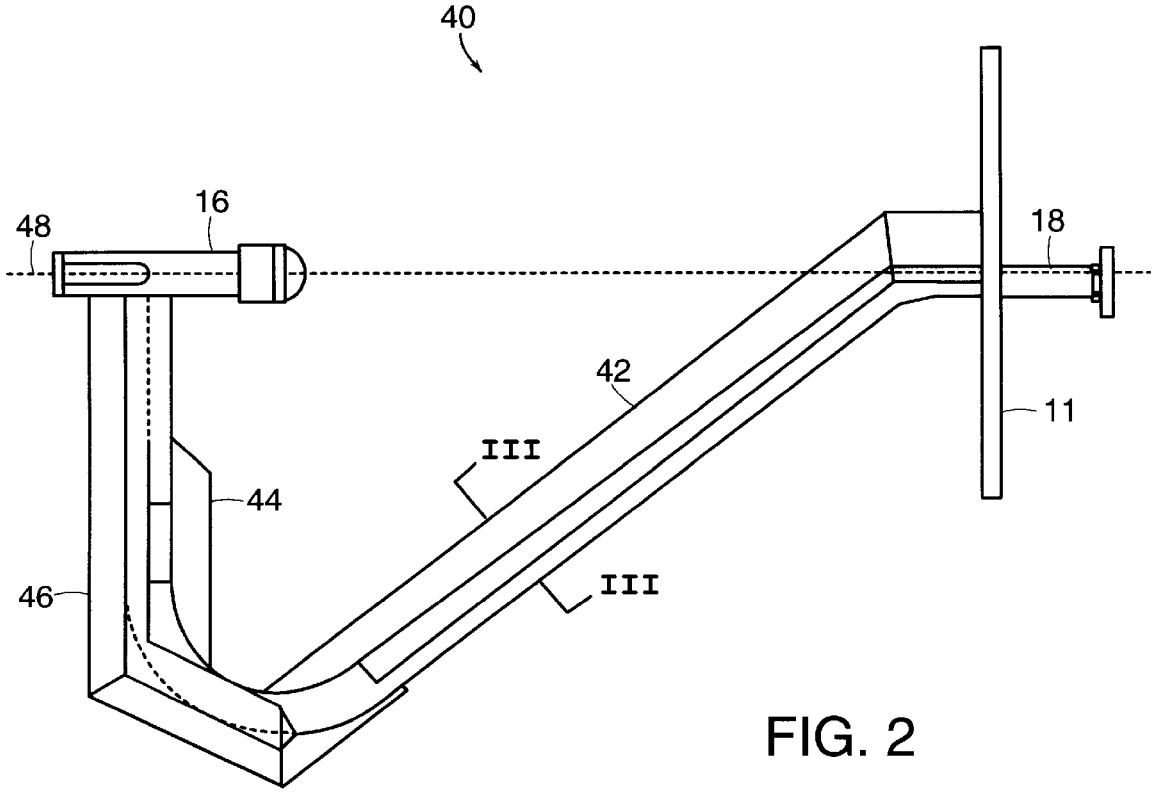
FIG. 2 is a side view of the current invention showing the feed spoiler coupled to the button hook feed support of a microwave antenna.

Referring now to FIG. 2, a side-view and front view are shown of a microwave antenna feed incorporating the present invention and designated generally by numeral 40. The features of the prior art microwave antenna 10 (shown in FIG. 1), including a central section 11 of parabolic reflector 12, feed horn 16, and waveguide 18, are shown. Waveguide 18 is here, again, depicted in a characteristic buttonhook configuration, by way of example, although other configurations of feed support and waveguide coupling of microwave signal to feed horn 16 are within the scope of the invention. A first feed spoiler 42, a second feed spoiler 44, and a third feed spoiler 46, are coupled to waveguide 18 in a manner to be described. First feed spoiler 42 is alternatively referred to as "stealth 1," second feed spoiler 44 is alternatively referred to as "stealth 2," and third feed spoiler 46 is alternatively referred to as "stealth 3," and feed spoiler segments, generally, as applied to microwave antenna waveguide feeds are referred to as "adaptive stealth elements."

Before the application of adaptive stealth feed to the button hook of the reflector antenna, the scattering level of the untreated feed support (button hook) structure is usually high, contributing to the high sidelobes (near in & far out) and cross polarization levels. The scattering pattern of the button hook feed support without adaptive stealth elements can be approximated as follows:

$$f_s \approx \sum_i L_i \frac{\sin A_i \sin B_i}{A_i B_i} e^{jk(x_i u + y_i v)} \cdot g_i \cdot E(x_j, y_j)$$

where $A_i=(kW_i/2)\sin\theta\cos(\phi+\delta)$;

$B_i=(k\,L_i/2)\sin\theta\cos(\phi+\delta)$;

$u=\cos\theta\sin\phi$;

$v=\sin\theta$;

$(\theta,\phi)$ are polar coordinates; $\delta$ is the polarization angle;

$E(x_i, y_i)$ is the feed illumination at $(x_i, y_i)$;

$g_i=g_{\|}\cos^2\delta+g_{\perp}\sin^2\delta$; $g_{\|}=IFR_E$; $g_{\perp}=IFR_H$;

$W_i$=projected width of $i^{th}$ section of the button hook structure;

$L_i$=projected length of $i^{th}$ section of the button hook structure;

and IFR is an induced field ratio, as discussed below.

The design of feed spoiler segments is based on studies on the radar cross-section of objects of arbitrary cross-sectional shapes, as discussed in M. Skolnik, *Radar Handbook*, McGraw Hill (1970), which is incorporated herein by reference. Objects of different shapes generate different forward and backward scattering, and therefore exhibit unique signatures which are frequency and polarization dependent. Some objects display significantly low scattering in either forward or backward direction. A suitable method of analyzing the forward scattering from an infinite cylindrical structure with arbitrary cross-sections is the "induced field ratio (IFR)—hypothesis" and is discussed by W. V. T. Rusch et al., "Forward Scattering from Square Cylinders in the Resonance Region with Application to Aperture Blockage," *IEEE Transactions*, vol. AP-24, pp. 182–189 (1976), incorporated herein by reference, and references therein. The induced field ratio (IFR) is defined as the ratio of the forward-scattered field to the hypothetical field radiated in the forward direction by the plane wave in the reference aperture of width equal to the shadow of the geometrical cross-section of the cylinder on the incident wave front. IFR is, therefore, a measure of the forward scattering for different scatterers of arbitrary cross-section. The IFR is polarization dependent. When the incident E-field is aligned in the same plane as the longitudinal axis of the scatter, it is denoted by $IFR_E$, and it is denoted by $IFR_H$ when the E-field is normal to the axis of the scatterer. Mathematically, $$IFR_E = -\frac{z_0}{2wE_0}\oint J_s e^{jk\rho'\sin\phi'}\,dl, \text{ and}$$
$$IFR_H = \frac{1}{2wH_0}\oint H_z(\hat{a}_\eta\cdot\hat{n})e^{jk\rho'\sin\phi'}\,dl,$$

where Eo is the electric intensity of the plane wave, $Z_0$ is the intrinsic impedance of free space, $J_s$ is the axial component of the induced surface current density; $H_0$ is the magnetic field of the incident wave, $H_z$ is the total magnetic field in the axial direction of the scatterer, $\hat{a}_n$ and $\hat{n}$ are unit vectors in the direction of wave propagation and normal to the surface of the scatterer; W is the width of the scatter. Numerical simulation of the $IFR_E$ and $IFR_H$ for various scatterers of arbitrarily cross-section can be achieved by using the numerical technique called the moment method, as is well known to persons skilled in the art, and as is discussed by R. Harrington, *Field Computation by Moment Methods*, Macmillan (1968), which is herein incorporated by reference.

To improve the scattering characteristic, adaptive stealth elements 42, 44, and 46 are attached to the button hook support 18. While there is a slight increase in the over-all blockage, the induced field ratio for each individual stealth element is much smaller than that of untreated sections of the button hook.

Figure 3:
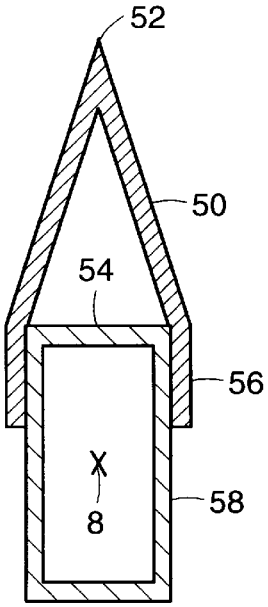
FIG. 3 is a view in cross-section, taken along the lines III—III of FIG. 2, of the current invention showing the feed spoiler coupled to a waveguide feed support of a microwave antenna.

The shape of each feed spoiler segment is the rooftop 50, otherwise referred to as an "ogive," shown in cross section in FIG. 3. As used in this description and in the appended claims, the terms "roof" and "rooftop" refer to a structure characterized by the confluence, along a linear region (which may, or may not, be straight) of two sheetlike faces which are joined along a common edge. The angle between the faces is typically in the range of 10°–30°, however other angles providing for substantial electromagnetic coverage of the feed spoiler segment by the rooftop may also be used within the claimed scope of the invention. Referring further to FIGS. 2 and 3, feed spoilers 42, 44, and 46 may be fabricated out of any electrically conducting material. In the preferred embodiment, brass sheet is employed. Rooftop 50 is coupled to waveguide 18 so as to extend out from the narrow dimension 54 of the waveguide and to substantially cover waveguide 18 and thus to hide it electromagnetically from radiation directed toward or away from concave reflector 12. Sleeves 56, or, alternatively, the edges of the faces of feed spoilers 42, 44, and 46 distal to ridge 52, may overlap the wide dimension 58 of the waveguide, and may be attached using any bonding technique. Ideally, ridge 52 should be pointed, however a small radius provides acceptable results. In a preferred embodiment, feed spoilers 42, 44, and 46 are glued to waveguide 18. In a preferred embodiment, further, in which the invention is applied to parabolic reflector 12 having a 2-ft diameter and microwave radiation in the band between 21.2 Ghz and 23.6 Ghz, the height of ridge 52 of rooftop 50 is approximately 1.5 wavelengths of the microwave radiation, or, on the order of the dimension of width of appropriately sized rectangular waveguide, as measured from the center 8 of waveguide 18. The precise dimension results from optimization to meet desired specifications of the radiation pattern.

Figure 4:
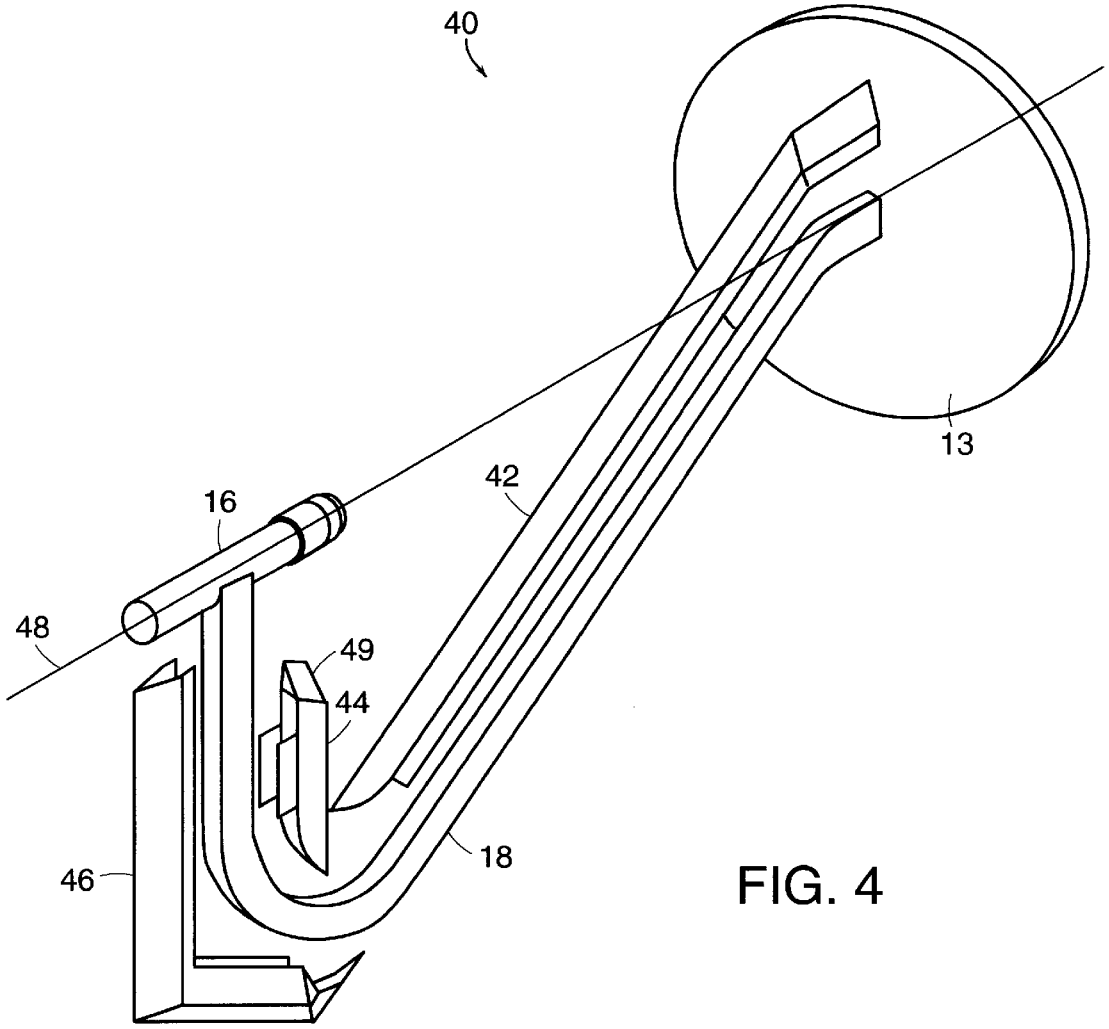
FIG. 4 is an exploded view from the side of the current invention showing the feed spoiler coupled to the button hook feed support of a microwave antenna.

Referring now to FIG. 4, an exploded view of microwave antenna feed 40 incorporating the current invention shows the feed spoiler coupled to the button hook feed support 18 of a microwave antenna. First feed spoiler 42 is disposed along the horizontally and diagonally oriented segments of waveguide 18, more specifically along the edge facing feed horn 16. Second feed spoiler 44 is disposed along the vertically oriented segment of waveguide 18, more specifically along the edge facing concave reflector 12. In one embodiment, it extends from bend 6 upward fully to feed horn 16. In a preferred embodiment, second feed spoiler 44 is terminated in a taper 49. Third feed spoiler 46 is disposed along the vertically oriented segment and around bend 6 of waveguide 18, more specifically along the edge facing away from central portion 13 of parabolic reflector 12 (shown in FIG. 2). In a preferred embodiment of the invention, feed spoilers 42, 44, and 46 may be disposed so that ridges 52 run parallel to the corresponding portions of feed support 18 which the feed spoilers hide.

In an alternative embodiment of the invention, applied to parabolic reflector 12 having a 4-ft diameter and a circular pipe (not shown) supporting waveguide 18 above bend 6, feed spoiler 42 has two rooftops 50 in a double profile shape such as to extend to both narrow sides 54 of waveguide 18. A feed spoiler having two rooftops may also cover one or more other portions of waveguide 18 within the scope of the present invention.

Figure 5:
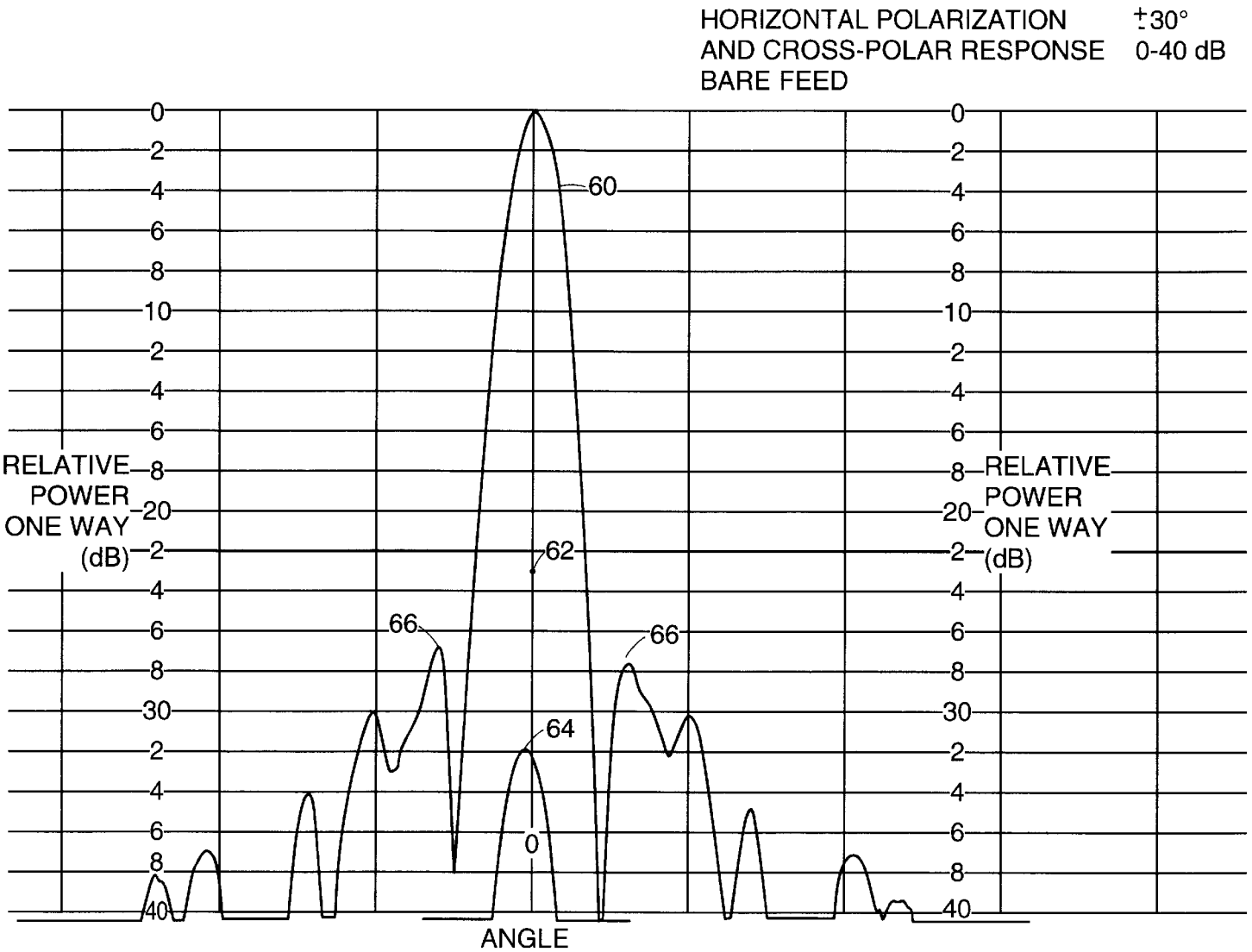
FIG. 5 depicts the measured co-polar and cross-polar response of a horizontally polarized microwave antenna having a parabolic reflector and a bent plane-polarized feed.
Figure 6:
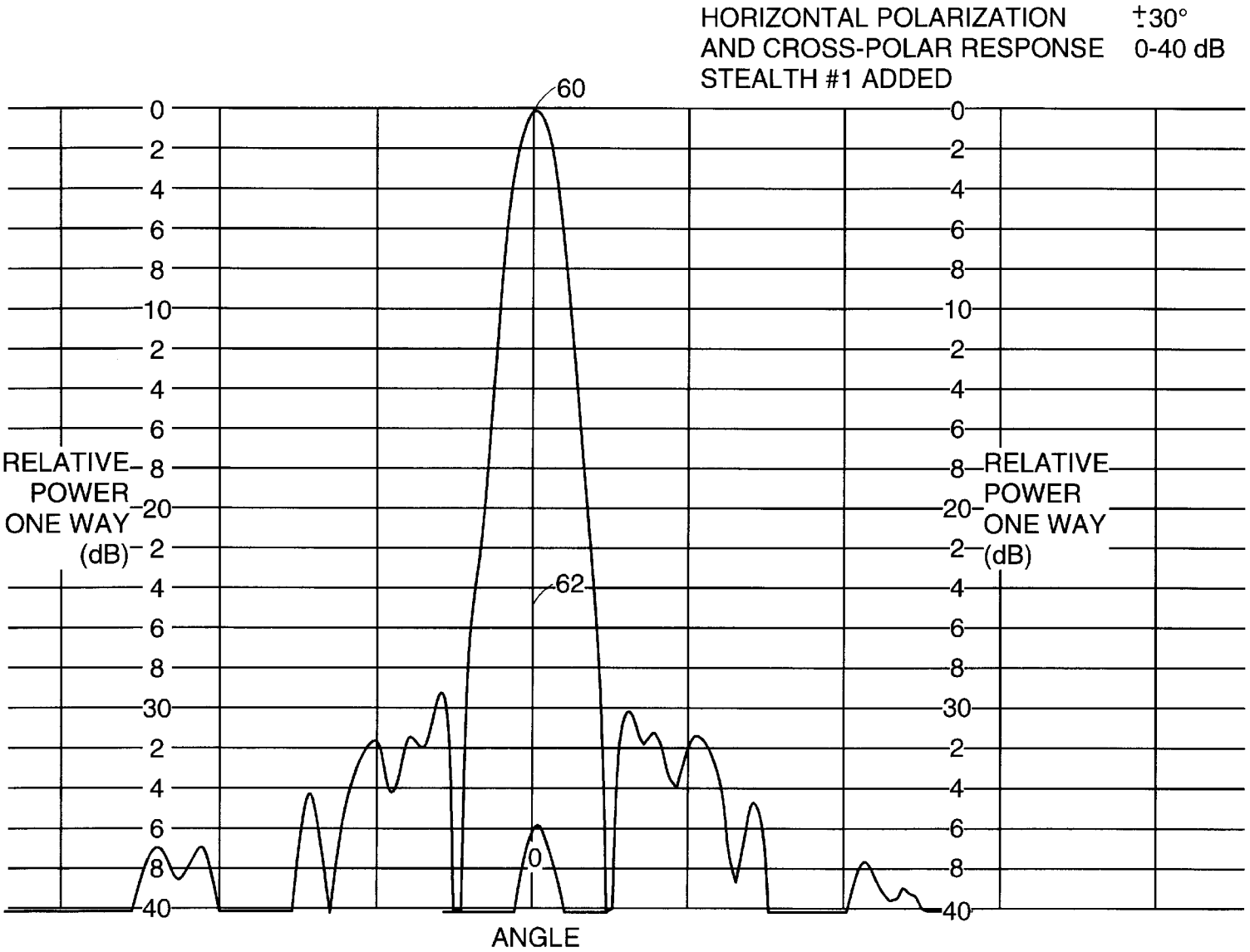
FIG. 6 depicts the measured co-polar and cross-polar response of a horizontally polarized microwave antenna having a parabolic reflector and a bent plane-polarized feed and further incorporating one feed spoiler segment of the current invention.

FIGS. 5–10 depict features of the resulting radiation pattern due to successive application of feed spoiler segments described with reference to FIGS. 2–4. In FIGS. 5–6 the radiated power in the far field 60 is displayed in units of relative power, with the vertical axis measured from zero, at the main beam peak, to −40 dB, as a function of angle, shown in units of degrees about the axis 62 of the main beam. Both the cross polar response 64 and sidelobes 66 are seen to be reduced in the pattern of FIG. 6, in which a first feed spoiler segment 42 (shown in FIG. 4) is employed, compared to the pattern of FIG. 5, which corresponds to a bare feed.

Figure 7:
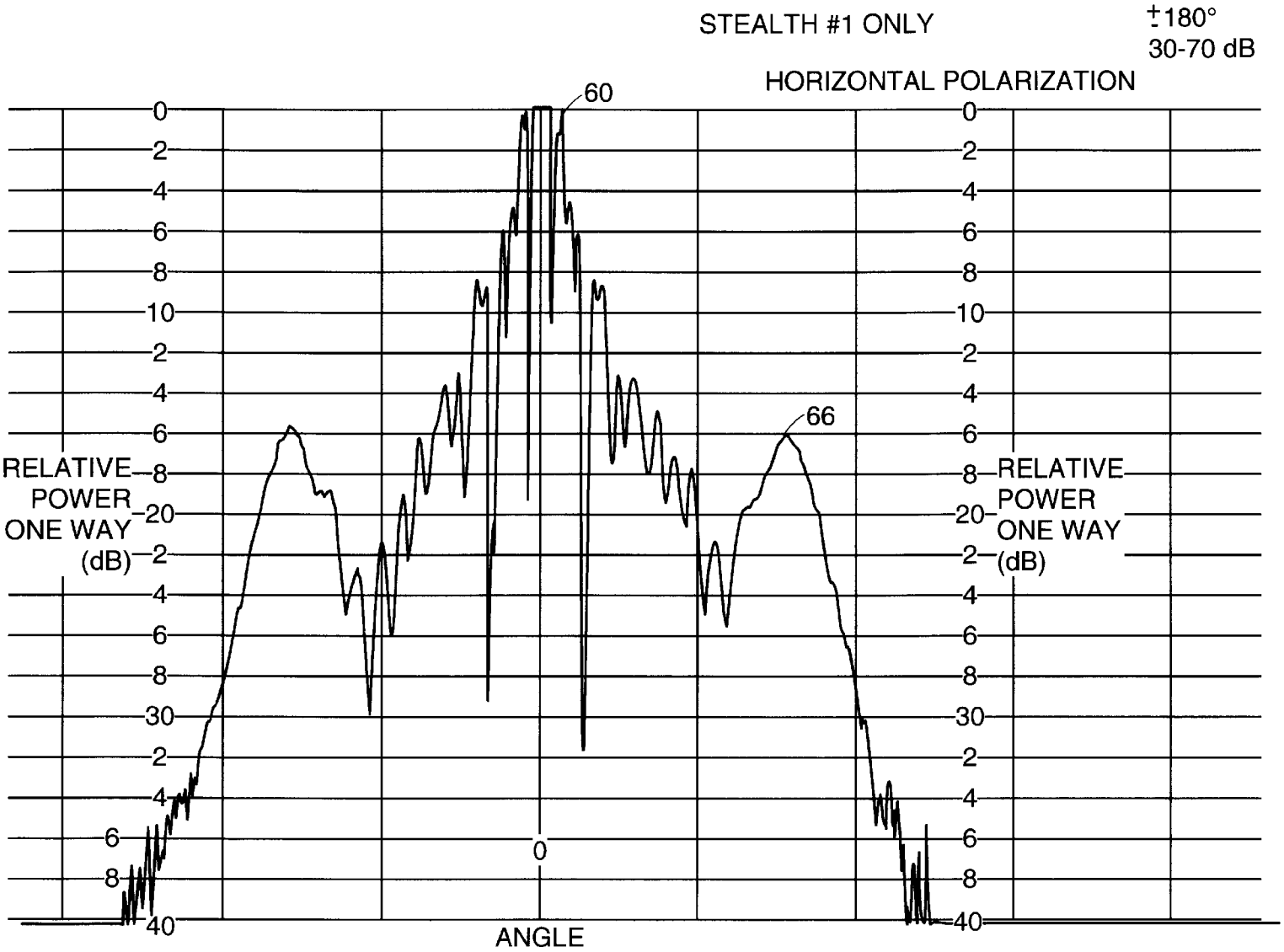
FIG. 7 is a measured far-field radiation pattern of the horizontally polarized radiation of a microwave antenna having a parabolic reflector and bent plane-polarized feed and further incorporating one feed spoiler segment of the current invention.
Figure 8:
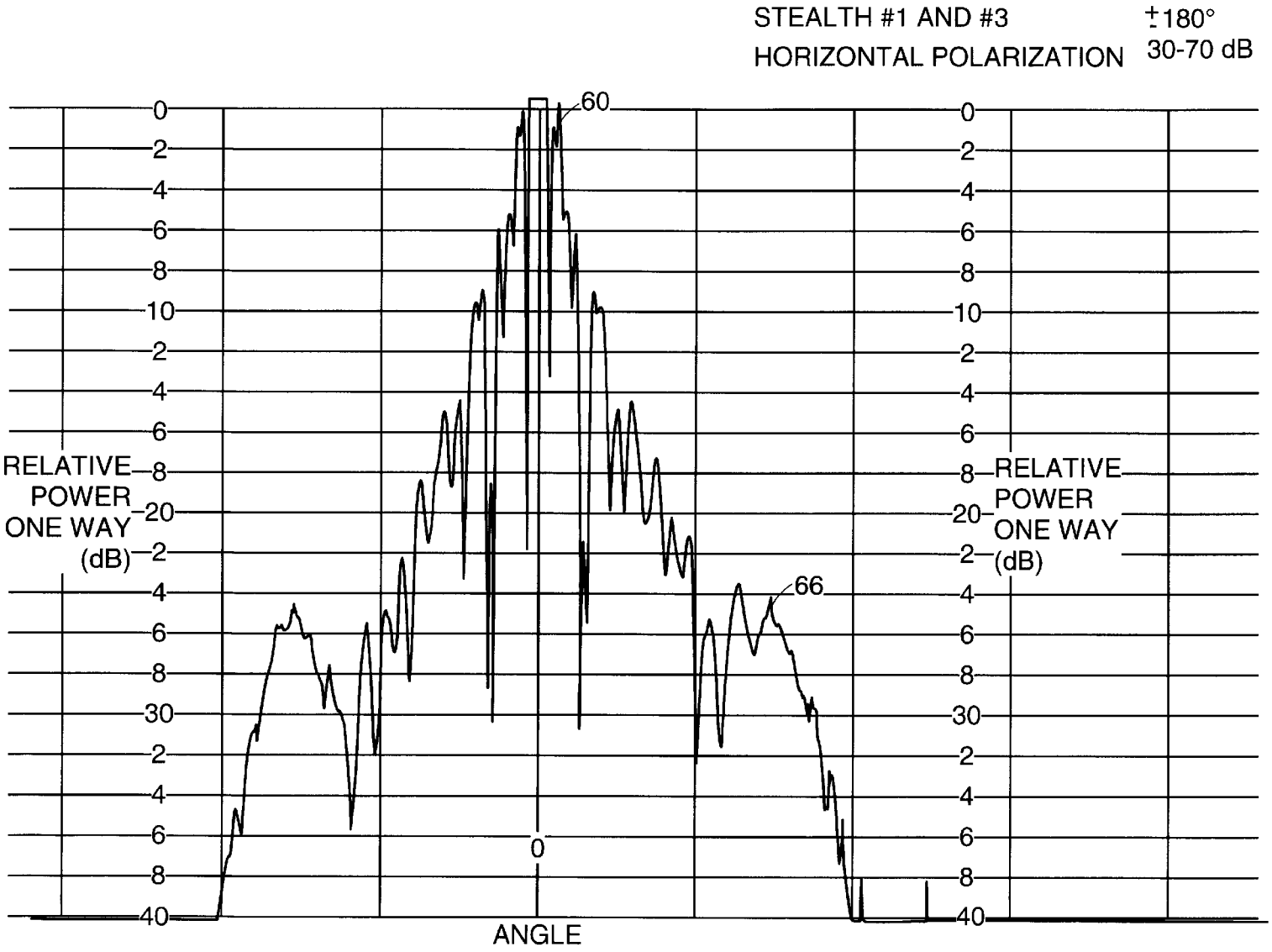
FIG. 8 is a measured far-field radiation pattern of the horizontally polarized radiation of a microwave antenna having a parabolic reflector and bent plane-polarized feed and further incorporating two feed spoiler segments of the current invention.
Figure 9:
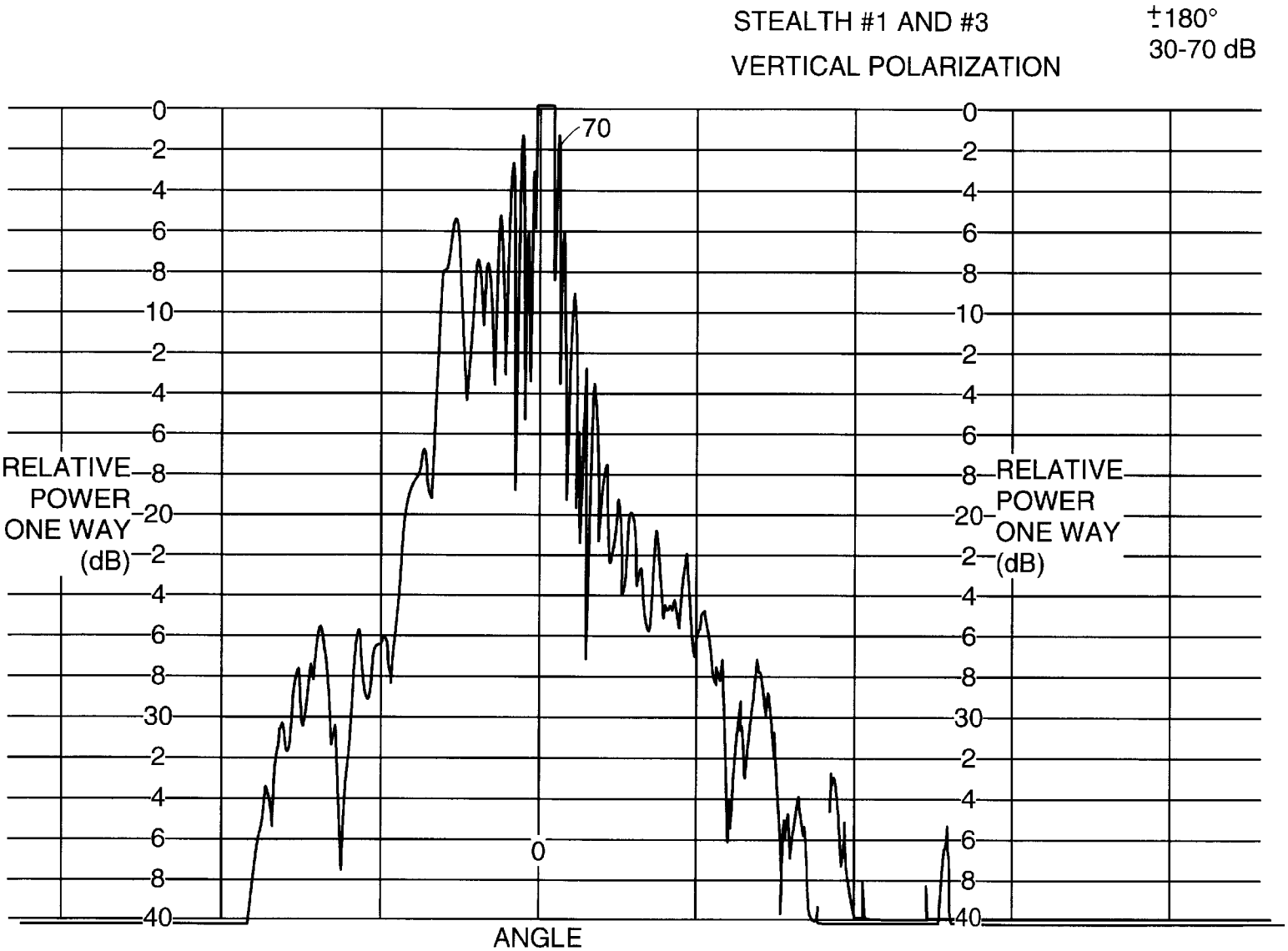
FIG. 9 is a measured far-field radiation pattern of the vertically polarized radiation of a microwave antenna having a parabolic reflector and bent plane-polarized feed and further incorporating two feed spoiler segments of the current invention.
Figure 10:
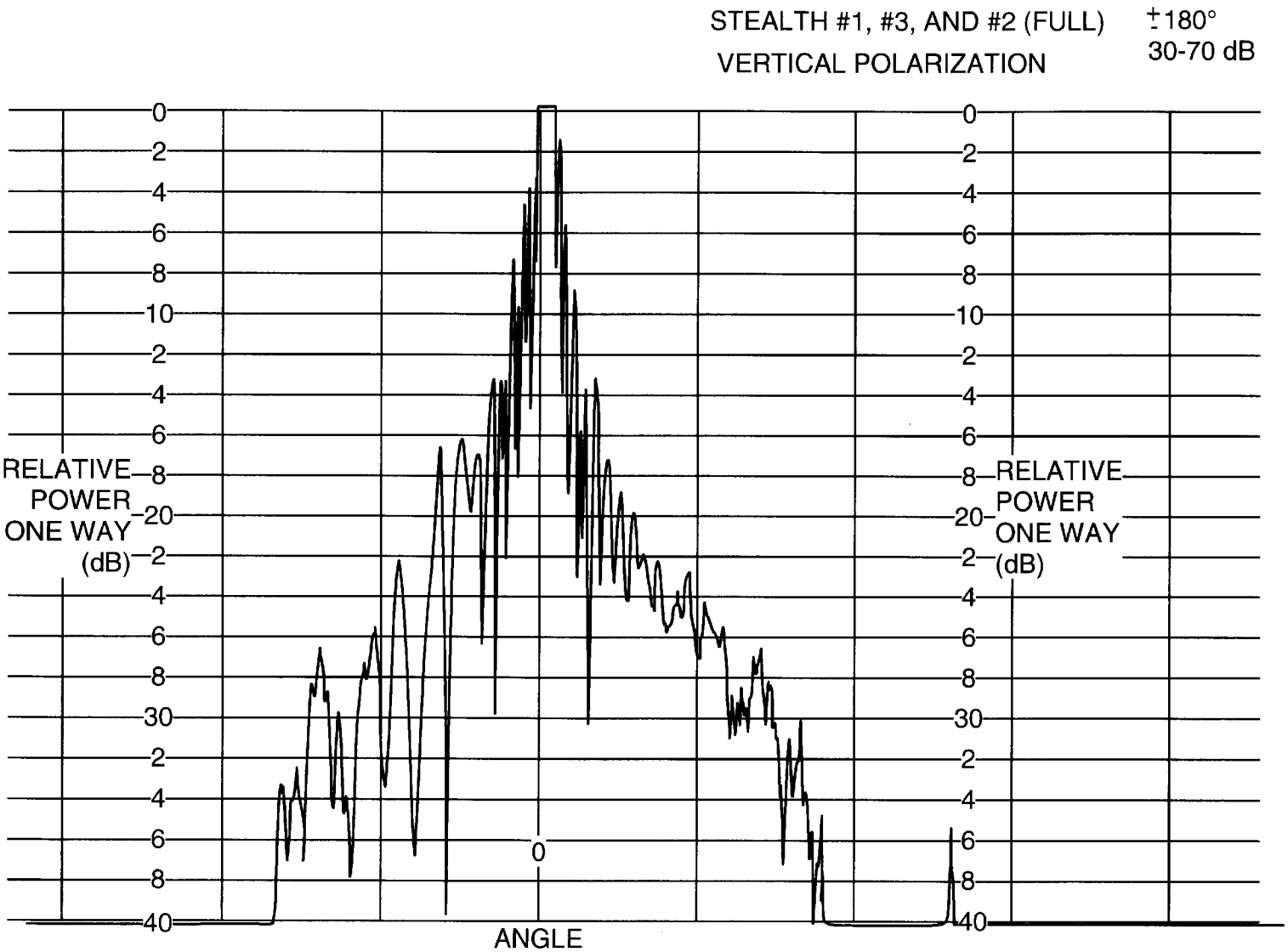
FIG. 10 is a measured far-field radiation pattern of the vertically polarized radiation of a microwave antenna having a parabolic reflector and bent plane-polarized feed and further incorporating three feed spoiler segments of the current invention.
Figure 11:
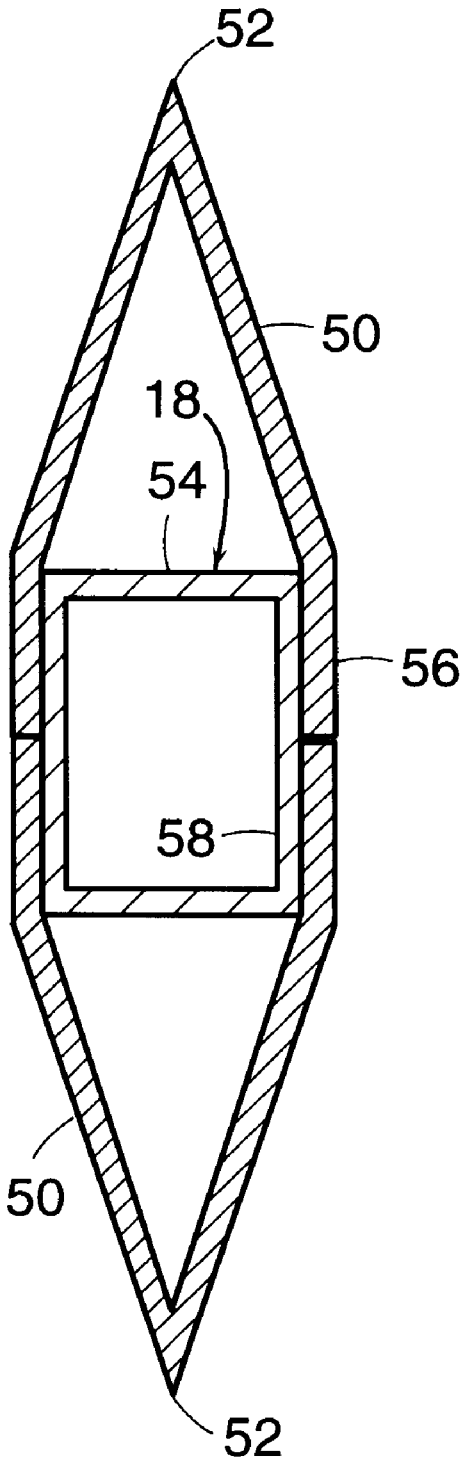
FIG. 11 is a view in cross-section of the alternative embodiment of the current invention showing two feed spoilers coupled to a waveguide feed support of a microwave antenna.

In FIGS. 7–10, the scale of the vertical axis ranges between −30 dB at the top, to −70 dB, at the bottom. All patterns shown in FIGS. 5–10 were measured on a 2-ft diameter dish at a frequency of 22.8 Ghz. In all cases, the antenna has a shroud with a full absorber lining and radome. FIGS. 7–10 allow comparison of the amplitude of sidelobes 66 under conditions in which differing segments of feed spoiler have been applied in accordance with varying embodiments of the invention. In FIG. 7, only first feed spoiler 42 ("stealth 1") has been applied. In FIG. 8, second feed spoiler 44 ("stealth 2") has also been applied, resulting in reduced sidelobes 66. While radiation pattern 60 shown in FIGS. 7 and 8 correspond to the horizontal polarization of transmitted or received radiation, FIG. 9 depicts a corresponding radiation pattern 70 of vertically polarized radiation in the presence of both first feed spoiler 42 and second feed spoiler 44. FIG. 10 depicts radiation pattern 60 of vertically polarized radiation with first, second, and third feed spoilers, 42, 44, and 46, applied.

The described embodiments of the invention are intended to be merely exemplary and numerous variations and modifications will be apparent to those skilled in the art. All such variations and modifications are intended to be within the scope of the present invention as defined in the appended claims.

We claim:

1. A feed spoiler for reducing side lobes of a microwave antenna having a concave reflector, a beam axis, and a feed support projecting out from the concave reflector to support a feed horn, the feed spoiler comprising at least one segment of electrically conductive surface forming a roof structure having a first and second face, each face having a first edge and a second edge, the first edges of the first and second faces being separated by at least the width of the feed support, and the second edges of the first and second faces being joined to form at least one ridge in such a manner as to substantially cover at least one segment of the feed support.

2. A feed spoiler according to claim 1, wherein the at least one ridge parallels at least one segment of the feed support.

3. A feed spoiler according to claim 1, wherein the first edges of the first and second face are electrically coupled to the feed support.

4. A feed spoiler according to claim 1, wherein the at least one segment of electrically conductive surface forms a roof having two faces each having an edge coupled to a portion of said feed support such that the opposite edges of the faces of the roof are joined to form a ridge in such a manner as to hide a portion of said feed support facing the feed horn.

5. A feed spoiler according to claim 1, wherein the at least one segment of electrically conductive surface forms a roof having two faces each having an edge coupled to a portion of said feed support such that the opposite edges of the faces of the roof are joined to form a ridge in such a manner as to hide a portion of said feed support perpendicular to said beam axis and facing said concave reflector.

6. A feed spoiler according to claim 1, wherein the at least one segment of electrically conductive surface forms a roof having two faces each having an edge coupled to a portion of said feed support such that the opposite edges of the faces of the roof are joined to form a ridge in such a manner as to hide a portion of said feed support perpendicular to said beam axis and facing away from said concave reflector.

7. A microwave antenna comprising:

a. a concave reflector having a beam axis;

b. a feed support projecting out from the concave reflector;

c. a feed horn supported by an end of the feed support distal to the concave reflector; and d. at least one segment of electrically conductive surface forming a roof structure having a first and second face, each face having a first edge and a second edge, the first edges of the first and second faces being separated by at least the width of the feed support, and the second edges of the first and second faces being joined to form at least one ridge in such a manner as to hide at least one segment of the feed support.

8. A microwave antenna according to claim 7, wherein the at least one ridge parallels a segment of the feed support.

9. A microwave antenna according to claim 7, wherein the first edges of the first and second face are electrically coupled to the feed support.

10. A microwave antenna according to claim 7, further comprising a segment of electrically conductive surface forming a roof having two faces each having an edge coupled to a portion of said feed support such that the opposite edges of the faces of the roof are joined to form a ridge in such a manner as to substantially cover a portion of said feed support facing said feed horn.

11. A microwave antenna according to claim 7, further comprising a segment of electrically conductive surface forming a roof having two faces each having an edge coupled to a portion of said feed support such that the opposite edges of the faces of the roof are joined to form a ridge in such a manner as to substantially cover a portion of said feed support perpendicular to said beam axis and facing said concave reflector.

12. A microwave antenna according to claim 7, further comprising a segment of electrically conductive surface forming a roof having two faces each having an edge coupled to a portion of said feed support such that the opposite edges of the faces of the roof are joined to form a ridge in such a manner as to substantially cover a portion of said feed support perpendicular to said beam axis and facing away from said concave reflector.

13. A feed spoiler for reducing side lobes of a microwave antenna for transmitting and receiving electromagnetic radiation having a characteristic wavelength, the microwave antenna having a concave reflector, a beam axis, and a waveguide feed having a rectangular cross-section with height and width cross-sectional dimensions, comprising at least one segment of electrically conductive surface forming a roof structure having a first and second face, each face having a first edge and a second edge, the first edges of the first and second faces being separated by at least the width of the waveguide feed, and the second edges of the first and second faces being joined to form at least one ridge in such a manner as to substantially electromagnetically hide at least one segment of the waveguide feed.

14. A feed spoiler according to claim 13, wherein each ridge parallels a segment of the waveguide feed.

15. A feed spoiler according to claim 13, wherein the first edges of the first and second face are electrically coupled to the waveguide feed.

16. A feed spoiler according to claim 13, wherein the at least one segment of electrically conductive surface forms a roof having two faces each having an edge coupled to a portion of said waveguide feed such that the opposite edges of the faces of the roof are joined to form a ridge in such a manner as to substantially electromagnetically hide a portion of said waveguide feed facing the feed horn.

17. A feed spoiler according to claim 13, wherein the at least one segment of electrically conductive surface forms a roof having two faces each having an edge coupled to a portion of said waveguide feed such that the opposite edges of the faces of the roof are joined to form a ridge in such a manner as to substantially electromagnetically hide a portion of said waveguide feed perpendicular to said beam axis and facing said concave reflector.

18. A feed spoiler according to claim 13, wherein the at least one segment of electrically conductive surface forms a roof having two faces each having an edge coupled to a portion of said waveguide feed such that the opposite edges of the faces of the roof are joined to form a ridge in such a manner as to substantially electromagnetically hide a portion of said waveguide feed perpendicular to said beam axis and facing away from said concave reflector.

19. A feed spoiler according to claim 13, wherein said feed spoiler comprises a segment of electrically conductive surface forming a roof having two faces each having an edge coupled to opposite edges of the height of a portion of said waveguide perpendicular to said beam axis and facing said concave reflector such that the opposite edges of the faces of the roof are joined to form a ridge parallel to said portion of said waveguide.

20. A feed spoiler according to claim 13, wherein the ridge of said roof is disposed at a distance on the order of one and a half times the characteristic wavelength of the electromagnetic radiation from the center of the cross-section of the rectangular waveguide feed.

21. A feed spoiler for reducing side lobes of a microwave antenna having a concave reflector, a beam axis, and a feed support projecting out from the concave reflector and to support a feed horn, comprising at least one segment of electrically conductive surface forming two roofs, each roof having two faces, each face having an edge coupled to at least a portion of the feed support up to the whole length thereof, such that the opposite edges of the faces of each roof are joined to form ridges disposed on opposite sides of said feed support.

* * * * *